US006347506B1

(12) United States Patent
Backmeister

(10) Patent No.: US 6,347,506 B1
(45) Date of Patent: Feb. 19, 2002

(54) YARN DRAW-OFF NOZZLE IN AN OPEN-END SPINNING MACHINE

(76) Inventor: Felix Backmeister, Postfach 23, A-6858 Dornbirn (DE)

( * ) Notice: Subject to any disclaimer, the term of this patent is extended or adjusted under 35 U.S.C. 154(b) by 0 days.

(21) Appl. No.: 09/502,316

(22) Filed: Feb. 11, 2000

(30) Foreign Application Priority Data

Feb. 13, 1999 (DE) ..... 199 06 111

(51) Int. Cl.[7] ..... D01H 4/40; D01H 4/00

(52) U.S. Cl. ..... 57/417

(58) Field of Search ..... 57/417

(56) References Cited

U.S. PATENT DOCUMENTS

| | | | | |
|---|---|---|---|---|
| 3,805,505 A | | 4/1974 | Schuster | 57/58.89 |
| 4,610,134 A | | 9/1986 | Busch et al. | 57/417 |
| 5,265,406 A | * | 11/1993 | Schlomer et al. | 57/417 |
| 6,035,625 A | * | 3/2000 | Schlomer et al. | 57/417 |

FOREIGN PATENT DOCUMENTS

| | | |
|---|---|---|
| EP | 422615 B1 | 4/1991 |
| GB | 1568070 | 5/1980 |

OTHER PUBLICATIONS

Official Search Report of German Priority Application No. 199 06 111.4 (Aug. 17, 1999). Untranslated.

First Official Action of the German Patent Office dated Jan. 30, 2001 in applicant No. DE 199 06 111.4–26 to which priority is claimed in the present US application. On information and belief, in this Office Action, all claims (corresponding to claims 1–11 of the present US application) are rejected. Claims 1 and 2 are rejected as anticipated by DE–OS 2140157 of Schuster (corresponding to US 3,805,505 of Schuster). Claims 3, 4, 10, and 11 are rejected as obvious over Schuster, as well as the remaining claims. An English translation of the Official Action will be furnished upon request.

* cited by examiner

*Primary Examiner*—Andy Falik

(57) ABSTRACT

A draw-off nozzle in an open-end spinning machine is provided with grabbing notches, each of which has an entry wall on the entry side that is less steeply inclined than an impingement wall on the other side of the root of the notch. The notch wall can be straight, concave or convex, and preferably has a tangential transition to the lead-in wall, with an angle between the impingement wall and the perpendicular of between ten and thirty degrees and an angle between the entry-side wall of the notch and the perpendicular of between fifty and sixty degrees. Preferably an odd number of grabbing notches, with a notch positioning angle of thirty degrees to the perpendicular, are provided, uniformly disposed around the circumference of the lead-in funnel. The notch root itself may also be given a convex configuration.

16 Claims, 2 Drawing Sheets

YARN DRAW-OFF NOZZLE IN AN OPEN-END SPINNING MACHINE

FIELD OF THE INVENTION

The subject-matter of the invention is a draw-off nozzle in an open-end spinning machine.

BACKGROUND OF THE INVENTION

To produce a yarn by spinning, it is known to arrange a stationary draw-off nozzle in front of a rapidly rotating open-end rotor, in the rotational axis.

In a manner known in itself, the filaments are fed into the rotor where they lie on the inclined face of the rotor, form the yarn in the rotor notch, pass out of the rotor notch in the radially inwards direction and enter the stationary draw-off nozzle in the region of the rotational axis.

The purpose of the draw-off nozzle is to deflect the inherently twisted yarn leaving the rotor notch, and also to develop a false twist so that the spinning process remains stable.

It is known that such draw-off nozzles can be formed from a metallic material, a ceramic material, or a metal/ceramic composite.

To promote the propagation of the yarn twist into the rotor groove, it is known to form one or more notches in the wall of the lead-in funnel defining the draw-off nozzle. It is known to give such a notch a symmetrical cross-section, that is to say one where the entry wall and the impingement wall have precisely the same form, so that the result is a V-shaped, completely symmetrical notch.

Draw-off nozzles with symmetrical notch configurations which have hitherto existed on the market have notches with aperture angles ranging from 50° to 65°, depths of between 0.2 and 0.45 mm, and positioning angles in relation to the axis of from 10° to nearly 90°.

Moreover it is known to provide at least 3 such notches, and indeed 4, 6, 8 or 12 such notches, distributed around the circumference of the lead-in funnel.

A drawback of the known symmetrical notch configurations is that the incoming yarn takes up position randomly within the notch. Depending on the spinning conditions, it can even happen that the yarn does not find its way into the notch at all, but leaps over it in a haphazard manner.

Therefore the fundamental problem which the invention sets out to solve is to perfect the grabbing notches in a draw-off nozzle of the kind stated in the introduction so that, irrespective of the spinning conditions, every notch comes into play in a uniform manner, thus increasing spinning stability.

SUMMARY OF THE INVENTION

For the solution of the stated problem, the invention is characterized by the technical caching of claim 1.

The essential feature of the invention is that each grabbing notch has an entry wall raked at a shallower angle than the impingement wall adjoining it on the other side of the root of the notch.

Thus the invention proposes for the first time a grabbing notch that is asymmetrical, i.e. effectively tilted or angled towards the yarn entry side.

The essential benefit yielded by this technical teaching is that the entry wall on the entry side as it were advances to meet the yarn. The yarn dips smoothly on to the entry wall, which slopes in the yarn entry direction and guides the yarn to the root of the notch, where it is stopped abruptly; after the yarn has left the root of the notch, it is led back up the impingement wall, and so out of the notch.

Thus the significant feature of the present invention is that the skew of the grabbing notch towards the yarn entry side ensures that the yarn moves smoothly and steadily across the entry wall towards the root of the notch (incidentally undergoing braking as it does so), before running on to the impingement wall, and then leaving the notch again.

This has not been the case in the known state of the art. Because the entry wall was set at a sharp angle to the yarn entry direction, the yarn tended to leap over the entry wall altogether, and then to abruptly hit a steeply raked surface of the impingement wall (e.g. in the upper third of the impingement wall), so that the braking effect was unfavourable, and this sudden overleaping of the grabbing notch gave rise to high tension peaks in the yarn. The invention avoids these.

For the provision of a grabbing notch according to the invention there exist various possible embodiments, all of which are claimed as essential to the invention.

In a first embodiment of the present invention, the notch wall on the entry side is profiled essentially as a straight line which at its entry (i.e. radially outward) end meets the spherically curved lead-in wall of the funnel at a slight angle i.e. with a slight discontinuity. Advantageously a tangential transition to the free-formed surface of the nozzle occurs at at least one point of the entry side envelope.

In a second configuration, the entry wall of the notch, instead of being straight, has a spherical curvature (a convex curvature), and merges smoothly with the convex lead in wall of the funnel, which also has a spherical curvature. In this second embodiment there is no perceptible transition between the lead-in wall of the funnel and the wall of the notch on the entry side; in other words, a tangential transition prevails at all points.

In a third possible embodiment, the entry wall of the notch is not convex, but concave, and adjoins the spherically curved, convex lead-in wall at a discontinuous transition point, so that the wall on the entry side of the notch is saddleshaped for example.

The invention therefore relates to all transition states between the three stated extreme forms of the entry wall of the notch, namely the convex wall, the straight wall and the concave wall, tangential transitions on the entry side being advantageous and recommended. The markedness of the notch in its envelope is highly dependent on the radii defining the lead-in funnel.

At the radially inwards side of the notch wall lies the root from which the impingement wall rises on the exit side of the notch. A significant feature here is that the angle of the impingement wall to the perpendicular is greater than the angle of the entry wall to the perpendicular.

Thus the angle of entry can be in the range of say 50° to 65° to the perpendicular owing to the greater tilt of the entry wall of the notch, whereas the impingement wall on the exit side will have an angle in the range of say 10° to 30°. This angle is also called the stop angle.

The invention provides that the material of the lead-in funnel can be metal or ceramic or a metal/ceramic composite. Other materials, such as for example coated plastic material, coated metal, or similar, can also be used.

A notch depth of 0.1 to 0.4 mm, depending on the notch intensity required, is preferred; and an odd number of notches, such as 3, 5, 7, 9, 11 or 13 notches, uniformly disposed around the circumference of the lead-in funnel, is particularly preferred.

A notch positioning angle of 30° (±5°) is preferred. Rotor yarns are generally spun as Z-twist yarns. For the draw-off nozzle, this means that the yarn rotates anticlockwise when viewed in the yarn draw-off direction (that is looking down on the mouth of the nozzle from above), as indicated in FIG. 2. Accordingly, the stopping side of a notch should be located on the left of the root of the notch, and the entry side on the right; or, in the case of S-twist, the other way round. As already mentioned herein, the notch root should also lie on a straight line wherever possible, which is a first preferred configuration. In another configuration, the notch root has a spherically arched and convex form.

As already mentioned herein, the notch root should also lie on a straight line wherever possible, which is a first preferred configuration. In another configuration, the notch root has a spherically arched and convex form.

All details and features disclosed in the documents including the abstract, and in particular the embodiment illustrated in the drawings, are claimed as essential to the invention in so far as, individually or in combination, they are novel with respect to the state of the art.

The invention will now be described in detail with reference to drawings illustrating a number of ways of carrying out the invention. Further essential features and advantages of the invention will become apparent from the drawings and from the description thereof.

DETAILED DESCRIPTION

Figure 1:
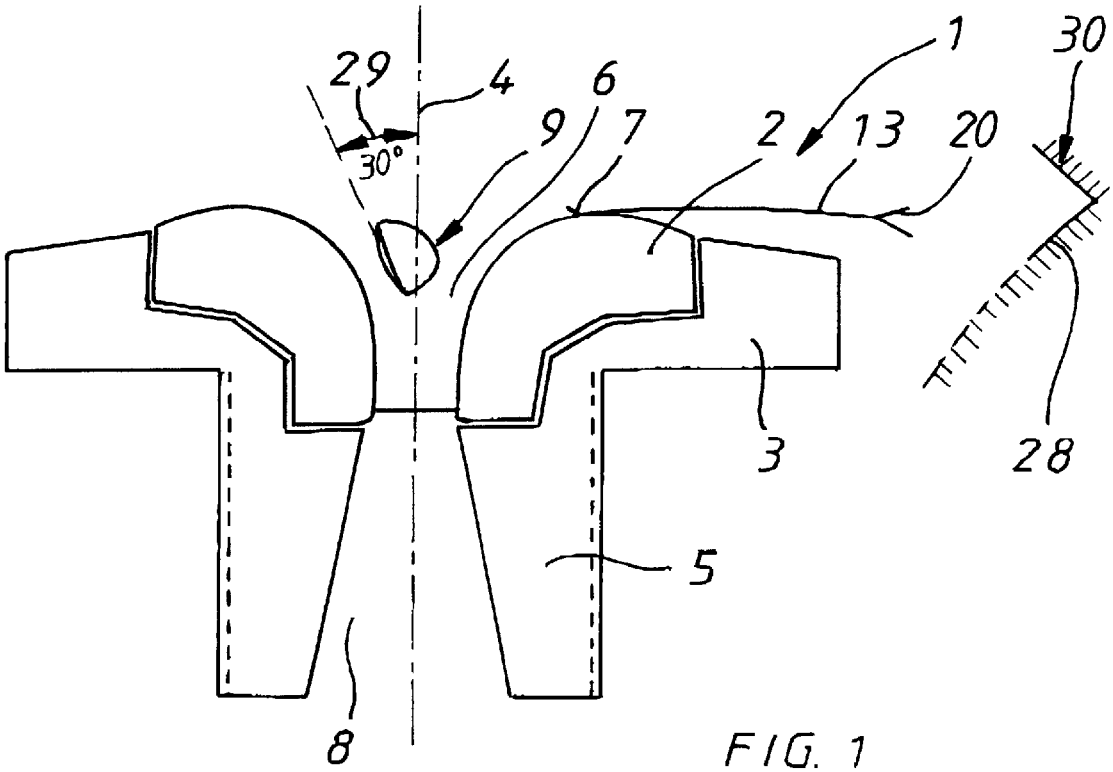
FIG. 1 is a section through a draw-off nozzle in a preferred first configuration for Z-twist.
Figure 2:
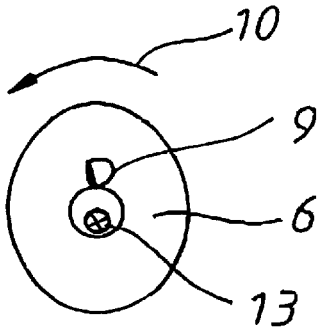
FIG. 2 is a top view of the lead-in funnel of the nozzle of FIG. 1.

FIG. 1 depicts the general arrangement of a fixed draw-off nozzle 1 whose axis of symmetry 4 coincides with the axis of rotation of a high-speed rotor 30 of which only the radially outer wall, with the rotor notch 28, is shown.

The filament runs into the rotor 30 in a manner known in itself, and leaves the rotor notch 28 in the direction indicated by the arrow 20. It then passes as yarn 13 into the nozzle 1, and exits downwards through the draw-off opening 8.

In one possible embodiment shown here, the draw-off nozzle 1 is in the form of an interchangeable part inserted in a nozzle holder 3. However, the invention is not limited to this particular option. The nozzle holder 3 can also be made integral with, and of the same material as, the nozzle 1.

The draw-off nozzle 1 can also be made of a multilayered material.

The important point is that in the region of the spherically shaped lead-in funnel 6 a lead-in wall 7 is formed which guides the yarn 13 in the direction of the arrow 20 into the nozzle 1. Thus the entire surface of the lead-in wall 7 in the insert 2 is touched by the yarn.

It should also be mentioned that in the embodiment shown in the drawing the nozzle holder 3 is screwed into a channel plate by a screw thread 5.

A series of grabbing notches 9 are evenly distributed around the circumference of the lead-in funnel 6. For the sake of clarity, only a single grabbing notch 9 has been shown in the drawing.

Figure 3:
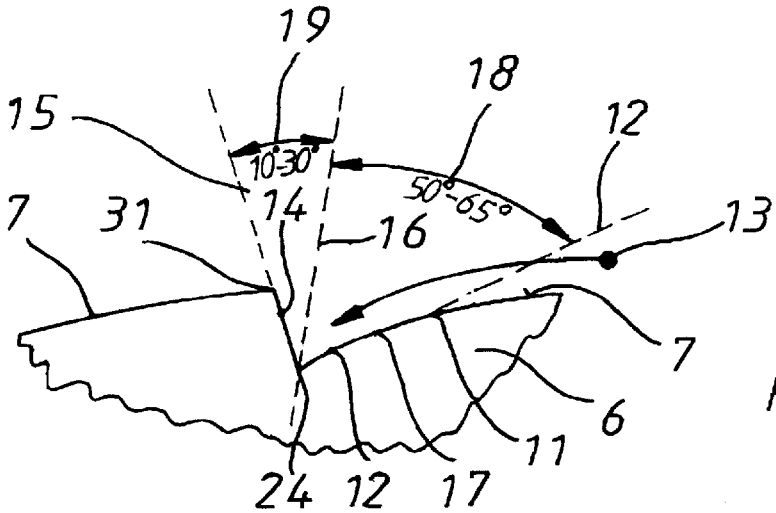
FIG. 3 is a section through the grabbing notch of FIG. 1 and FIG. 2.
Figure 6:
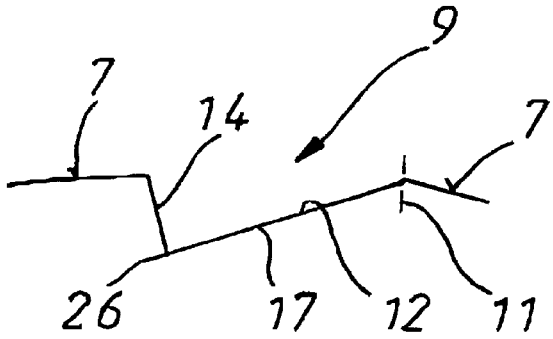
FIG. 6 is a section through the grabbing-notch of FIG. 3 [sic] drawn on an enlarged scale.

In accordance with the invention, the grabbing notch consists, as FIGS. 3 and 6 show, of a notch wall 17 on the entry side which starts from the spherically curved lead-in wall 7, adjoins said spherically curved lead-in wall 7 at a position 11, and extends as a straight line 12 down to the root 24 of the notch.

FIG. 3 shows that the straight line 12, which is steeper than the plane of the lead-in wall 7, makes an angle 18 in the range of e.g. 50° to 65° with the perpendicular 16.

Figure 4:
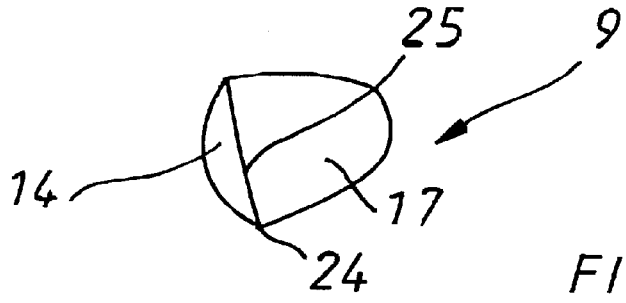
FIG. 4 is a top view of the grabbing notch according to FIGS. 1 to 3.

In this configuration the notch root 24 follows the notch line 25 of FIG. 4, which is a straight line.

Adjoining the notch root 24 on the exit side is the impinge which makes an angle 19 in the range of e.g. 10° to 30° with the perpendicular 16.

On the exit side, the impingement wall 14 has a discontinuous transition to the spherically curved lead-in wall 7.

The yarn 13 therefore slips smoothly over the spherically curved lead-in wall 7 and over the position 11 on to the straight line 12 which is angled slightly more sharply downwards, so that a soft landing is made at the root 24 of the notch. At the impingement wall 15 the yarn is then stopped very low down, in the region of the root 24, with maximum stopping effect, before ascending the impingement wall 14 along the straight line 15 and then reemerging on to the spherically curved lead-in wall 7 at the position 31.

Figure 5:
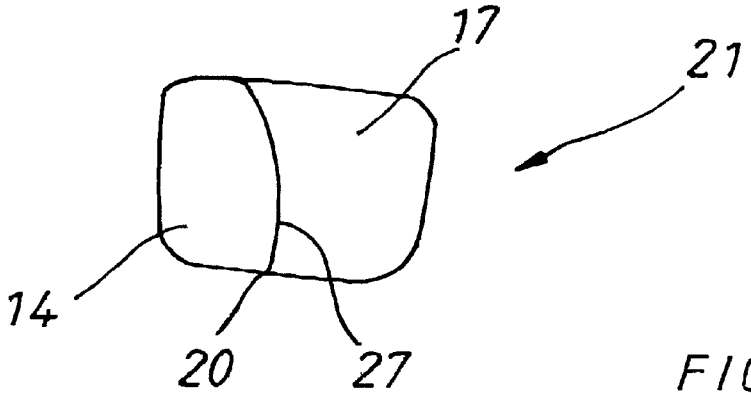
FIG. 5 shows a second embodiment of grabbing notch, with a spherically arched notch root.

FIG. 5 shows another form of grabbing notch 21 in which it can be seen that the notch root 26 is configured not as a straight line but as a notch line 27 with convex curvature i.e. one which follows a defined curve.

This curved notch line does not, of course, have to be a curve of constant radius, it may be a curve with non-constant radius such as an elliptical arc, a parabolic arc, etc.

Figure 7:
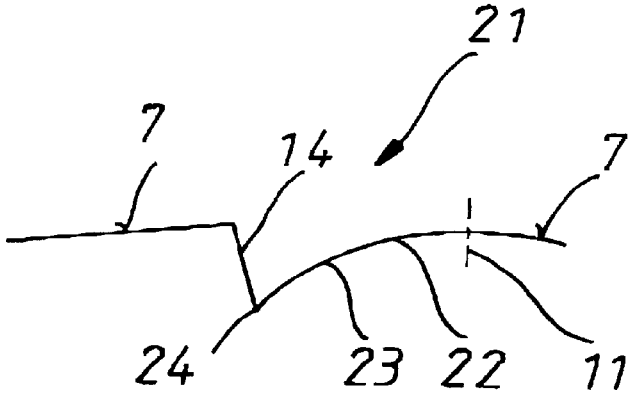
FIG. 7 is a section through a further embodiment of grabbing notch, with a tangential transition.

Similarly, as can be seen from FIG. 7, which shows a modified form, the line 12 forming the entry-side wall of the notch does not necessarily have to be configured as a straight line; instead, this line can be configured as a curve 22 which forms the entry-side wall 23. This curve 22 also does not necessarily have to be a curve with a constants radius throughout, and may be configured as a parabolic or elliptical curve.

Other forms of curve can also be devised to ensure that there is a smooth transition from the spherically curved lead-in wall 7 over the position 11 to the spherically curved curve 22.

Incidentally, FIG. 1 shows that the angle of the notch line 25, 27 (notch positioning angle 29) to the perpendicular may be of the order of 30°.

Drawing Legend

1 Draw-off nozzle
2 Insert
3 Nozzle holder
4 Axis of symmetry
5 Screw thread
6 Lead-in funnel
7 Lead-in wall (surface)

8 Draw-off opening
9 Grabbing notch
10 Yarn rotation direction
11 Position
12 Straight line
13 Yarn
14 Impingement wall
15 Straight line
16 Perpendicular
17 Entry-side wall of notch
18 Angle
19 Angle
20 Arrow denoting direction
21 Grabbing notch
22 Curve
23 Entry-side wall of notch
24 Root of notch
25 Line of notch
26 Root of notch
27 Line of notch
28 Rotor notch
29 Notch positioning angle
30 Rotor
31 Position

What is claimed is:

1. Yarn draw-off nozzle in an open-end spinning machine, comprising at least one grabbing notch having an entry wall on an entry side that is less steeply inclined than an impingement wall adjacent thereto on another side of a root of the notch; and wherein the entry-side wall of the notch has a profile essentially with convex spherical curvature and merges smoothly, with no transition angle, with a convex lead-in wall of a funnel, which also has a spherical curvature.

2. Yarn draw-off nozzle according to claim 1, wherein the entry-side wall of the notch is profiled essentially as a straight line which at its radially outward entry end meets a spherically curved lead-in wall of the funnel at a slight transition angle.

3. Yam draw-off nozzle according to claim 1, wherein an angle of the impingement wall to the perpendicular standing at right angles to the plane of the horizon lies between 10° and 30° and the angle of the entry-side wall of the notch to the perpendicular standing at right angles to the plane of the horizon lies between 50° and 65°.

4. Yarn draw-off nozzle according to claim 1, wherein the notch depth is between 0.1 mm and 0.4 mm.

5. Yarn draw-off nozzle according to claim 1, wherein a plurality of the at least one grabbing notch are uniformly disposed around the circumference of the lead-in funnel.

6. Yarn draw-off nozzle in an open-end spinning machine, comprising at least one grabbing notch having an entry wall on an entry side that is less steeply inclined than an impingement wall adjacent thereto on another side of a root of the notch; and wherein the entry-side wall of the notch has a profile that is essentially concave and meets a spherically curved, convex lead-in wall at a discontinuous transition point.

7. Yarn draw-off nozzle according to claim 6, wherein an angle of the impingement wall to the perpendicular standing at right angles to the plane of the horizon lies between 10° and 30° and the angle of the entry-side wall of the notch to the perpendicular standing at right angles to the plane of the horizon lies between 50° and 65°.

8. Yarn draw-off nozzle according to claim 6, wherein the notch depth is between 0.1 mm and 0.4 mm.

9. Yarn draw-off nozzle according to claim 4, wherein a plurality of the at least one grabbing notch are uniformly disposed around the circumference of the lead-in funnel.

10. Yarn draw-off nozzle in an open-end spinning machine, comprising at least one grabbing notch having an entry wall on an entry side that is less steeply inclined than an impingement wall adjacent thereto on another side of a root of the notch; and wherein a notch positioning angle is between 25° and 35° with respect to the axis of symmetry of the draw-off nozzle.

11. Yarn draw-off nozzle according to claim 10, wherein an angle of the impingement wall to the perpendicular standing at right angles to the plane of the horizon lies between 10° and 30° and the angle of the entry-side wall of the notch to the perpendicular standing at right angles to the plane of the horizon lies between 50° and 65°.

12. Yarn draw-off nozzle according to claim 10, wherein the notch depth is between 0.1 mm and 0.4 mm.

13. Yarn draw-off nozzle according to claim 10, wherein a plurality of the at least one grabbing notch are uniformly disposed around the circumference of the lead-in funnel.

14. Yarn draw-off nozzle according to claim 10, wherein the notch depth is between 0.1 mm and 0.4 mm.

15. Yarn draw-off nozzle in an open-end spinning machine, comprising at least one grabbing notch having an entry wall on an entry side that is less steeply inclined than an impingement wall adjacent thereto on another side of a root of the notch; and wherein the notch root has a spherically arched and convex configuration.

16. Yarn draw-off nozzle according to claim 15, wherein an angle of the impingement wall to the perpendicular standing at right angles to the plane of the horizon lies between 10° and 30° and the angle of the entry-side wall of the notch to the perpendicular standing at right angles to the plane of the horizon lies between 50° and 65°.

* * * * *